US005241952A

United States Patent [19]

Ortiz

[11] Patent Number: 5,241,952

[45] Date of Patent: Sep. 7, 1993

[54] THERAPEUTIC RANGE-OF-MOTION EXERCISE DEVICE

[76] Inventor: David G. Ortiz, 525 Auburn St., Kennewick, Wash. 99336

[21] Appl. No.: 859,845

[22] Filed: Mar. 30, 1992

[51] Int. Cl.[5] ..... A61F 5/00

[52] U.S. Cl. ..... 128/26; 434/261

[58] Field of Search ..... 434/247, 258, 260, 261, 434/175; 401/193; 128/25 R, 26

[56] References Cited

U.S. PATENT DOCUMENTS

| | | | |
|---|---|---|---|
| D. 176,586 | 1/1956 | Bogenberger | 434/175 X |
| 1,455,522 | 5/1923 | Cress | 434/175 |
| 1,982,843 | 12/1934 | Traver | 128/25 R |
| 3,206,873 | 9/1965 | Duus et al. | 434/175 |
| 3,363,335 | 1/1968 | Burhns et al. | 128/25 R |
| 3,837,095 | 9/1974 | O'Hara | 434/258 |
| 4,089,126 | 5/1978 | Lang | 434/258 X |
| 4,134,584 | 3/1979 | Rosenbusch . | |
| 4,149,713 | 4/1979 | McLeod | 128/25 R X |
| 4,640,268 | 2/1987 | Roberts | 128/25 R |
| 4,822,027 | 4/1989 | Kascak | 128/26 X |

*Primary Examiner*—Richard J. Apley
*Assistant Examiner*—Linda C. M. Dvorak

[57] ABSTRACT

A therapeutic range-of-motion exercise device is described herein as having a flat rectangular surface board with intersecting grooves routed into the top surface in patterns of, for example, a half circle, a straight line, and a straight line at a 45-degree angle. These patterns may vary from model to model in order to provide the user with progressively difficult patterns to increase rehabilitation benefits. The user places his hand into the hand guide, a flat hand-shaped device with a depression routed into the top surface for comfort, and a double set of hook and loop straps to secure the hand to the guide. A capped bolt protruding from the bottom of the guide slides into the grooves in the top surface of the board and the user pushes the handguide along these grooves, enabling him to stretch and rotate the arm and shoulder in a full range of motion. The range-of-motion board will accommodate the right or left arm of the patient.

6 Claims, 3 Drawing Sheets

THERAPEUTIC RANGE-OF-MOTION EXERCISE DEVICE

FIELD OF INVENTION

This invention relates in general to arm exercise devices, and in particular to therapeutic exercise devices that are used to improve the range of motion of the upper extremities.

BACKGROUND OF THE INVENTION

In order to provide background information for the invention, its purpose, and how it is an improvement over the prior art, it is necessary to explain the physical condition for which the invention was designed.

The therapeutic range-of-motion exercise device was intended to provide a means by which a person suffering from any weakness, stiffness, or debilitation of an arm or shoulder can practice range-of-motion exercises independently. For example, a person suffering arm and shoulder pain, stiffness, and weakness from arthritis, a stroke, or head-injured patient would greatly benefit from a device that could be used to exercise both in the hospital before release, and at home as part of ongoing therapy. Stroke or head-injured patients often suffer hemiplegia (i.e., a flaccidity of muscles on one half of the body, right or left depending on the side of the brain that sustained damage during the stroke). Flaccidity is an abnormally relaxed, flabby state of the muscles, but is not a true paralysis. Thus, therapy can improve muscle tone and even aid in recovery of the affected limb.

When one of the upper extremities is flaccid, the shoulder joint may become deformed (subluxated). In this situation, the flaccid arm pulls the long bone of the arm (humorous) out of the normal position in the shoulder socket. This dislocation occurs because the flaccid arm is heavy and the normal muscle tone that holds the humorous in the shoulder socket is gone.

To regain or maintain the muscle tone of the affected limb, range-of-motion exercises must be performed as a part of rehabilitation therapy. Range-of-motion exercises move the affected limb through the normal spatial arcs, loosening the muscles and preventing contractures (shortened muscles that prevent the joint from moving, often referred to as a "frozen" joint). Range-of-motion exercises are designed to prevent these disabling contracture and have traditionally been performed by skilled professionals in the hospital and then at home by a caregiver. Ideally, the patient would be transferred to a rehabilitation facility and additional intensive therapy would proceed. In reality, however, most patients do not have the resources or insurance to pay for continued therapy, and specialized facilities are often not logistically available.

Home therapy provided by the caregiver is often a problem. The problem stems not only from the necessity that the caregiver perform the range-of-motion exercises for the patient day after day, but also because these exercises are often painful; therefore, the patient will tend to resist letting the caregiver move the limb to the full extension of the normal spatial arcs. The solution to both of these problems is to give the patient the means to perform his own range-of-motion exercise so that he can exercise as often as necessary, and control the degree of pain he experiences during these exercises. Human nature dictates that a person in control of his own pain will be less fearful of pushing himself to his own limit, thus increasing rehabilitation benefits.

Heretofore, range-of-motion self-therapy for the upper extremities has consisted of placing the hand of the affected arm in a loop of soft rope or nylon line attached to an overhead pulley. The patient would then use the stronger arm to pull the other end of the rope or line to raise the weak arm. Although this method may increase and maintain a portion of the range of motion in the weakened limb, it does little to strengthen the muscles of the arm and shoulder girdle as does the invention herein described.

Another method of self-therapy currently practiced is to place a dust cloth in the hand of the patient's affected arm while he is seated at a table and instruct him to perform forward and back and wide circular motions. The patient will usually use the stronger arm to help the weak one to push the cloth. This simple method would probably work except for the fact that many patients with a considerable amount of debilitation from a stroke or head injury may also suffer a condition known as "aphasia" or "apraxia." This condition produces an inability to communicate verbally, and also inhibits the patient's comprehension of even simple verbal instructions. Therefore, the patient is often unable to perform the motion intended. Instead, he pushes the cloth a few inches forward and back or in small circles, gaining almost no range-of-motion benefit for his effort.

U.S. Pat. No. 4,134,584 to Rosenbusch, however, shows a "versatile arm skate." This skate provides arm and wrist exercise by requiring the patient to grasp a handle mounted on three rotatable casters and roll it along a flat surface. The device is purposely designed to tip over unless the patient exercises a somewhat precise muscular control to prevent the tipping. However, unless the patient's debilitation is minor, this exercise would be far too difficult to practice.

The object of the invention of this patent application is to provide the patient with an independent means to perform range-of-motion exercises. The patient is able to satisfy this objective by placing his hand in a push-along device, referred to herein as a "handguide," and pushing it along a pattern of grooves in the top of a flat rectangularly shaped board. The handguide is movably anchored to the board, enabling the patient to push it along the groove patterns, stretching the arm and working toward a plainly visible goal to complete the entire course.

The advantages of the invention disclosed herein over the prior art are that it provides a more effective means for the patient to perform his own exercise and push himself to his own limit, increasing the range-of-motion of the arm and shoulder, improving muscle tone and coordination in a patient who has almost none at the outset of therapy. The patient uses the strong hand and arm to help the weak one push the handguide along the groove patterns until the weak arm gradually gains enough strength and coordination to push the handguide along the grooves in the full range of motion.

The range-of-motion board is designed to be a relatively inexpensive alternative to hospital therapy. Range-of-motion therapy for stroke, head injured, or arthritic patients is an ongoing daily necessity that is often eventually neglected because health insurance runs out and the cost of a private therapist is prohibitive for most families. Caregivers, who are usually overburdened with the general care of the patient would benefit from the respite from performing therapy that having this device in the home would give them.

List of Reference Numerals

Figure 1:
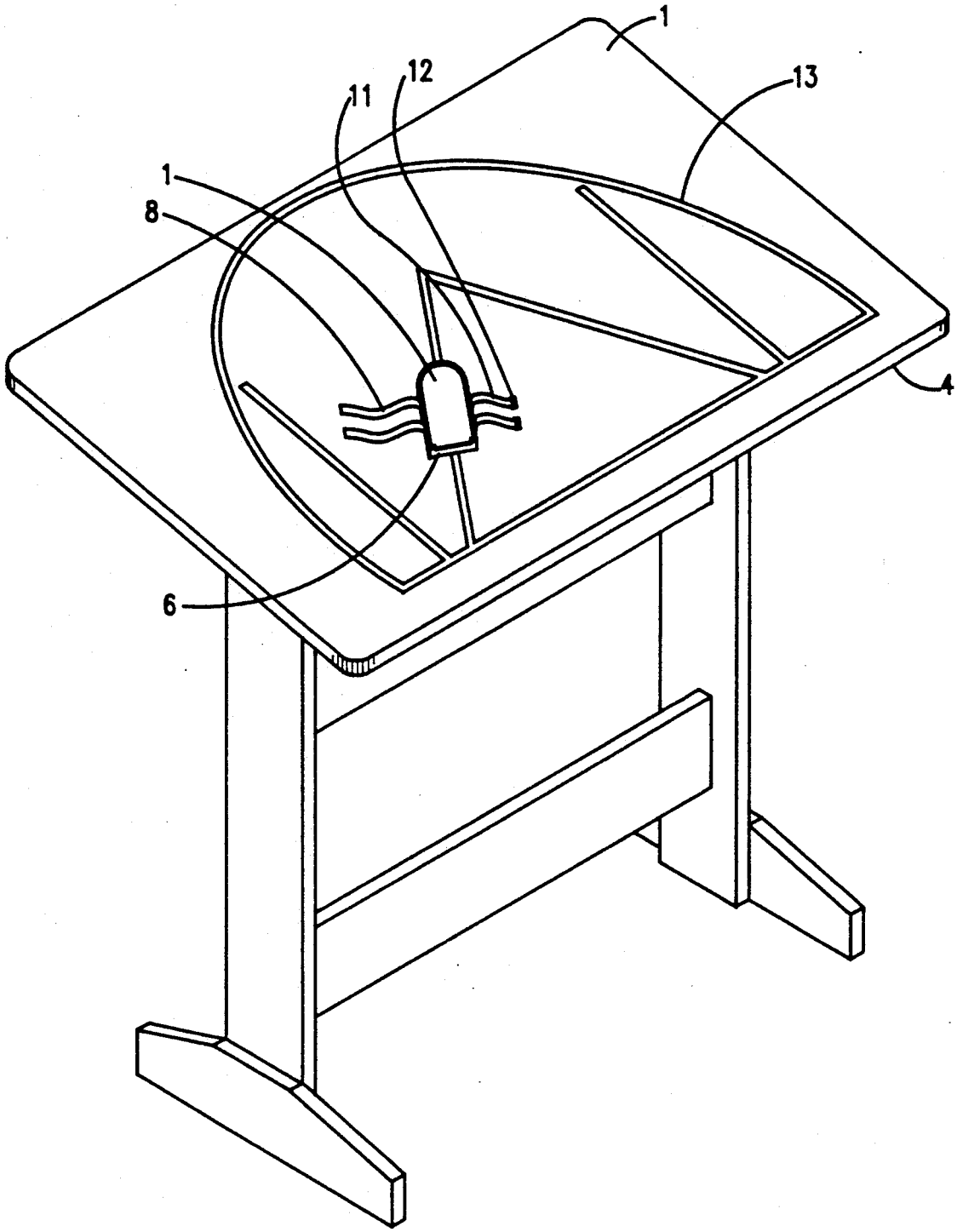
FIG. 1 is a perspective view of the present invention showing the preferred embodiment with the support of a wooden stand that is not included as a part of this patent application.

1 Plastic laminate covering
2 ¼-inch particle board
3 ¾-inch particle board
4 plastic T-molding
5 ¾-inch grooved channel
6 hardwood handguide base
7 wood screws that attach straps to handguide
8 left-side straps with hook and loop fabric fastener
9 handguide tracking bolt
10 bolt cap (fits into groove)
11 right-side straps
12 buckle rings for right-side straps
13 ⅜-inch grooved channel

NARRATIVE DESCRIPTION OF THE INVENTION

Figure 2:
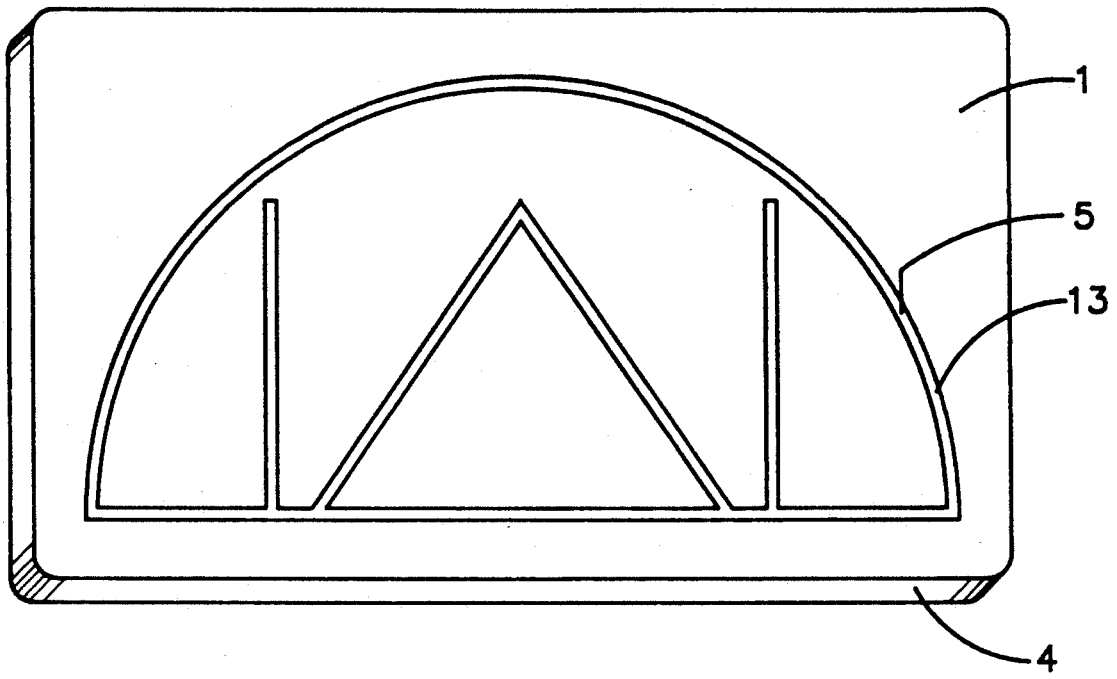
FIG. 2 is a top elevational view of the present invention minus the handguide unit.
Figure 3:
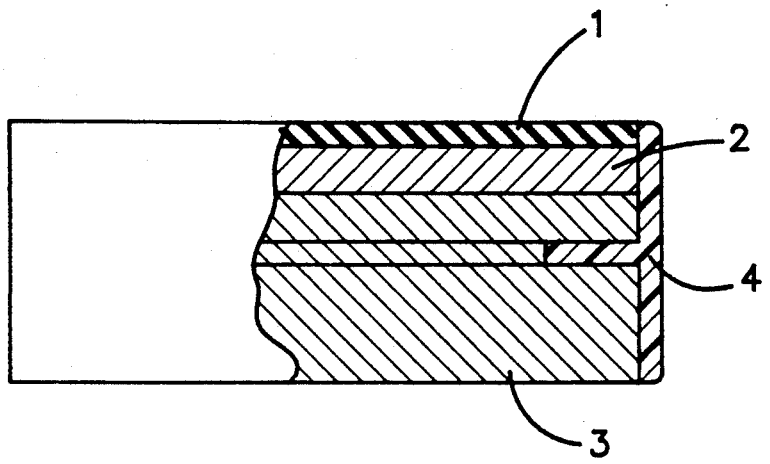
FIG. 3 is a cross-sectional view (of one edge of the invention showing how the plastic T-molding fits into a groove routed around the perimeter edge of the board.

The therapeutic range-of-motion exercise device disclosed herein is described as an arm and shoulder exercise device, which consists of a flat, rectangularly shaped board with deep grooves routed or cut in the top surface of the board in intersecting patterns of, for example, a half circle, a straight perpendicular line, and a line at a 45-degree angle (FIGS. 1 and 2). Other patterns can be used on different models to provide variety and a higher degree of difficulty for the user, increasing rehabilitation benefits. A handguide unit (FIG. 4) slides along the grooves in the board by means of a specially designed bolt (FIG. 5) which is screwed through the center of the guide and out through the bottom where a bolt cap is threaded onto the end of the bolt. The cap is then fitted into the grooves on the board (FIG. 3). The user can push the handguide along the grooves with the weak arm, stretching and rotating the arm and shoulder in the full range of motion. The device can be made to sit on an existing table, or as a free-standing model with legs.

DETAILED DESCRIPTION OF THE PREFERRED EMBODIMENTS

The therapeutic range-of-motion exercise device is comprehensively described as follows:

1. The overall dimensions of the top of the range-of-motion board are 48 inches×30 inches. These dimensions can be modified for different models or for a multiple-user board.

2. The range-of-motion board is made of three layers of material, which are cut and routed in the following steps:

a. One sheet of ¾-inch×4-foot×8-foot particle board [3] is cut 48 inches×30 inches with a 1-inch radius cut at corners. This piece of particle board is then routed with a ¾-inch bit with a ¼-inch shank to a ½-inch depth to match the grooved pattern [5] in FIG. 2.

b. Then a sheet of ¼-inch×4-foot×8-foot particle board [2] is cut to the same dimensions of 48 inches×30 inches with a 1-inch radius cut at corners, the same as the first layer of particle board.

c. The ¼-inch [2]and the ¾-inch particle board [3] pieces are then glued together. The ¼-inch particle board [2] is routed with a ⅜-inch bit with a ¼-inch shank through the board in the same pattern as the first ¾-inch layer to create an interlocking channel [5][13] for the tracking bolt [9] attached to the bottom of the handguide (FIG. 2 and 3).

d. A plastic laminate [1] is glued over the top and routed with a ⅜-inch bit with a ¼-inch shank to match the grooved pattern in the two layers of particle board. The excess plastic laminate is routed off the perimeter to create a smooth edge. This edge is then finished by attaching a plastic molded trim (1-inch wide) [4] around the perimeter of the board.

Figure 4:
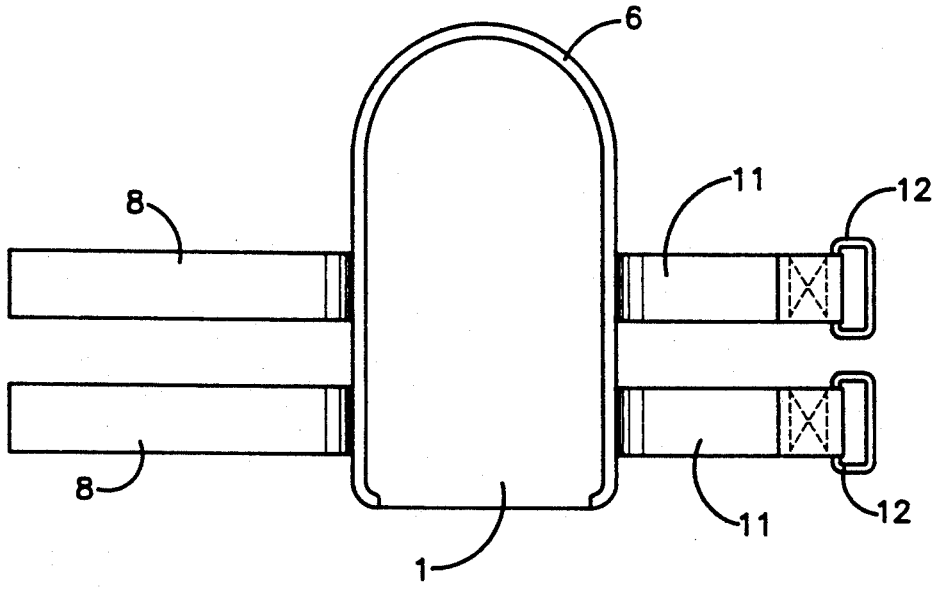
FIG. 4 contains an elevation view of the handguide unit.
Figure 5:
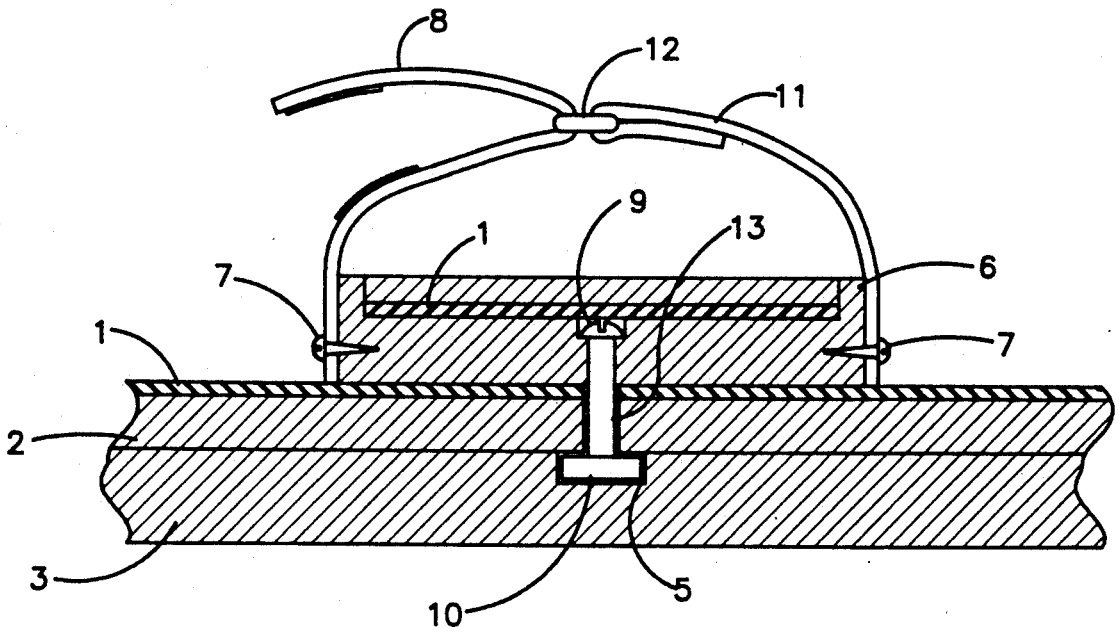
FIG. 5 is a cross-sectional view of the handguide showing how the unit will fit into the channel grooves of the board.

3. The handguide for the device is made of the following pieces:

a. A piece of hardwood is cut to measure ¾-inch×6 inches×9 inches long [6]. A ¼-inch deep, hand-shaped depression is routed into the center portion of the board to accommodate either a right or left hand (FIG. 4). A ¼-inch hole is drilled through the center of the board for the tracking bolt [9].

b. The tracking bolt [9] is inserted through the center of the handguide base [6] from the top through the bottom and the cap [10] is threaded onto the end of the bolt [9]. Plastic laminate is glued to the inside of the depression routed into the top of the hardwood handguide ,base [6], covering the head of the bolt. A double set of hook and loop fastening straps [8] are attached with wood screws [7] to the lower and upper parts of the handguide [6] on the left side and canvas straps [11] with buckle rings [12] are attached with wood [7] screws to the lower and upper parts on the right side to the guide (FIG. 4).

SUMMARY

The therapeutic range-of-motion exercise device for upper extremities consists of a flat, rectangularly shaped board with intersecting grooves routed into the top surface in patterns of, for example, a half circle, a straight perpendicular line, and a straight line routed at a 90-degree angle. These patterns will vary from one model to the next to provide the user with progressively difficult range-of-motion goals to increase rehabilitation benefits. A handguide device with a specially-designed bolt protruding from the bottom and inserted into the grooves will slide along the groove pattern. The user will place his hand in the handguide and push it along the pattern of grooves, using his good arm to help the weak one to complete the exercise until the weak arm is strong enough to perform the exercise without assistance.

The therapeutic range-of-motion exercise device can be used easily and conveniently by a patient in the hospital or at home. The device enables the patient to perform the exercises without assistance and to control his own progress without the fear of being hurt by another person. It also provides a clearly visible, easily understandable goal for range-of-motion exercise by means of a pattern of intersecting grooves, helps build strength and coordination as well as improving and maintaining maximum mobility, helps prevent shoulder subluxation by improving muscle tone, encourages the patient to become as independent as possible, and relieves the caregiver from the need to assist the patient to perform daily range-of-motion exercise.

In another embodiment of the invention, the grooves in the board are cut in a different pattern, requiring more effort from the patient to complete the range-of-motion course, thereby increasing the rehabilitation benefits.

A further embodiment is that the range-of-motion device can also be manufactured in other shapes, such as circular or oval to allow a variety of pre-cut grooves of range-of-motion patterns in the surface of the board. It can also be made much longer and wider to accommodate more than one user for an institutional-size model, and it can be made from a variety of materials such as molded plastic, fiberglass, aluminum, stainless steel, etc., taking into consideration which of the methods of manufacture will be most environmentally safe. Models can be made to sit upon an existing table, or can be fitted with its own legs for a free-standing model.

Thus, the scope of the invention should be determined by the appended claims and their legal equivalents, rather than by examples given.

I claim:

1. A therapeutic exercise device for use by a seated person having a size sufficient to accommodate the maximum reach of the average human arm for practicing range-of-motion exercise movements of the joints of the upper extremities, comprising:

a. a rectangular-shaped sheet of rigid material, b. a plurality of intersecting grooved channels routed in a pattern of a half circle encompassing the perimeter of the top surface of said rectangular-shaped sheet of rigid material with a channel intersecting the bottom of the half circle in a straight perpendicular line and a channel routed in a 45-degree angle also intersecting the bottom of the half circle, whereby the user is provided a pattern to use as a guide for range-of-motion exercise movements, c. a hand-guiding attachment having a means for insertion into said intersecting grooved channels, joined perpendicularly to the underside of the attachment, and having fastening means to secure the hand to the guide.

2. The invention of claim 1 wherein said rectangular-shaped sheet of rigid material is made of two separate sheets of rigid material and one layer of plastic laminate covering.

3. The invention of claim 2 wherein the first of said two sheets of said rectangular-shaped sheet of rigid material is approximately ¾ inch in thickness and the second of said two sheets is ¼ inch in thickness.

4. The invention of claim 3 wherein said ¾-inch sheet of said rectangular-shaped sheet of rigid material is routed with ¾-inch-wide channels to a depth of ½ inch in said pattern of a half circle encompassing the perimeter of the top surface of said rectangular-shaped sheet of rigid material with a channel intersecting the bottom of the half circle in a straight perpendicular line and a channel routed in a 45 -degree angle also intersecting the bottom of the half circle.

5. The invention of claim 3 wherein said ¼-inch sheet of said rectangular-shaped sheet of rigid material is secured to the top of the said ¼-inch sheet of rigid material and is then routed through the ¼-inch depth in a ⅜-inch-wide channels to match said pattern.

6. The invention of claim 1 wherein said fastening means comprises a double set of hook and loop fastening straps.

* * * * *